US005621368A

United States Patent [19]

Galloway

[11] Patent Number: 5,621,368

[45] Date of Patent: Apr. 15, 1997

[54] CONTAINER ATTACHABLE SPRAY TUBE HOLDER

[76] Inventor: Ken E. Galloway, 6228 Winters St., Fort Wayne, Ind. 46816

[21] Appl. No.: 531,419

[22] Filed: Sep. 21, 1995

[51] Int. Cl.[6] ..... H01F 7/20

[52] U.S. Cl. ..... 335/285; 206/350; 206/818

[58] Field of Search ..... 335/285; 206/350, 206/818

[56] References Cited

U.S. PATENT DOCUMENTS

| | | | |
|---|---|---|---|
| 3,556,341 | 1/1971 | Rains | 220/90.4 |
| 4,457,425 | 7/1984 | Cooper et al. | 206/38 |
| 4,785,562 | 11/1988 | Good | 40/159.1 |
| 5,274,937 | 1/1994 | Birnbaum | 40/600 |
| 5,313,181 | 5/1994 | Negus | 335/285 |
| 5,328,411 | 7/1994 | Thornton, II | 473/36 |

*Primary Examiner*—Michael L. Gellner
*Assistant Examiner*—Raymond M. Barrera

[57] ABSTRACT

A container attachable spray tube holder for securing a spray tube relative to an aerosol container. The inventive device includes a tube receiver for receiving a spray robe commonly provided with an aerosol container. A mounting assembly is secured to the tube receiver for mounting the receiver to a side of an aerosol container such that the spray tube can be easily stored in adjacency relative to the container.

1 Claim, 2 Drawing Sheets

CONTAINER ATTACHABLE SPRAY TUBE HOLDER

BACKGROUND OF THE INVENTION

1. Field of the Invention

The present invention relates to holding devices and more particularly pertains to a container attachable spray tube holder for securing a spray tube relative to an aerosol container.

2. Description of the Prior Art

The use of holding devices is known in the prior art. More specifically, holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding devices include U.S. Pat. Nos. 5,274,937; 4,457,425; 5,313,181; 5,328,411; and U.S. Pat. No. 4,785,562.

While these devices fulfill their respective, particular objectives and requirements, the aforementioned patents do not disclose a container attachable spray tube holder for securing a spray robe relative to an aerosol container which includes a rube receiver for receiving a spray robe commonly provided with an aerosol container, and a mounting assembly secured to the tube receiver for mounting the receiver to a side of an aerosol container such that the spray tube can be easily stored in adjacency relative to the container.

In these respects, the container attachable spray tube holder according to the present invention substantially departs from the conventional concepts and designs of the prior art, and in so doing provides an apparatus primarily developed for the purpose of securing a spray tube relative to an aerosol container.

SUMMARY OF THE INVENTION

In view of the foregoing disadvantages inherent in the known types of holding devices now present in the prior art, the present invention provides a new container attachable spray tube holder construction wherein the same can be utilized for securing a spray tube relative to an aerosol container. As such, the general purpose of the present invention, which will be described subsequently in greater detail, is to provide a new container attachable spray tube holder apparatus and method which has many of the advantages of the holding devices mentioned heretofore and many novel features that result in a container attachable spray tube holder which is not anticipated, rendered obvious, suggested, or even implied by any of the prior art holding devices, either alone or in any combination thereof.

To attain this, the present invention generally comprises a container attachable spray tube holder for securing a spray tube relative to an aerosol container. The inventive device includes a tube receiver for receiving a spray tube commonly provided with an aerosol container. A mounting assembly is secured to the tube receiver for mounting the receiver to a side of an aerosol container such that the spray tube can be easily stored in adjacency relative to the container.

There has thus been outlined, rather broadly, the more important features of the invention in order that the detailed description thereof that follows may be better understood, and in order that the present contribution to the an may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container attachable spray tube holder apparatus and method which has many of the advantages of the holding devices mentioned heretofore and many novel features that result in a container attachable spray tube holder which is not anticipated, rendered obvious, suggested, or even implied by any of the prior art tool guides, either alone or in any combination thereof.

It is another object of the present invention to provide a new container attachable spray tube holder which may be easily and efficiently manufactured and marketed.

It is a further object of the present invention to provide a new container attachable spray tube holder which is of a durable and reliable construction.

An even further object of the present invention is to provide a new container attachable spray tube holder which is susceptible of a low cost of manufacture with regard to both materials and labor, and which accordingly is then susceptible of low prices of sale to the consuming public, thereby making such container attachable spray tube holders economically available to the buying public.

Still yet another object of the present invention is to provide a new container attachable spray tube holder which provides in the apparatuses and methods of the prior art some of the advantages thereof, while simultaneously overcoming some of the disadvantages normally associated therewith.

Still another object of the present invention is to provide a new container attachable spray tube holder for securing a spray tube relative to an aerosol container.

Yet another object of the present invention is to provide a new container attachable spray tube holder which includes a tube receiver for receiving a spray tube commonly provided with an aerosol container, and a mounting assembly secured to the tube receiver for mounting the receiver to a side of an aerosol container such that the spray tube can be easily stored in adjacency relative to the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
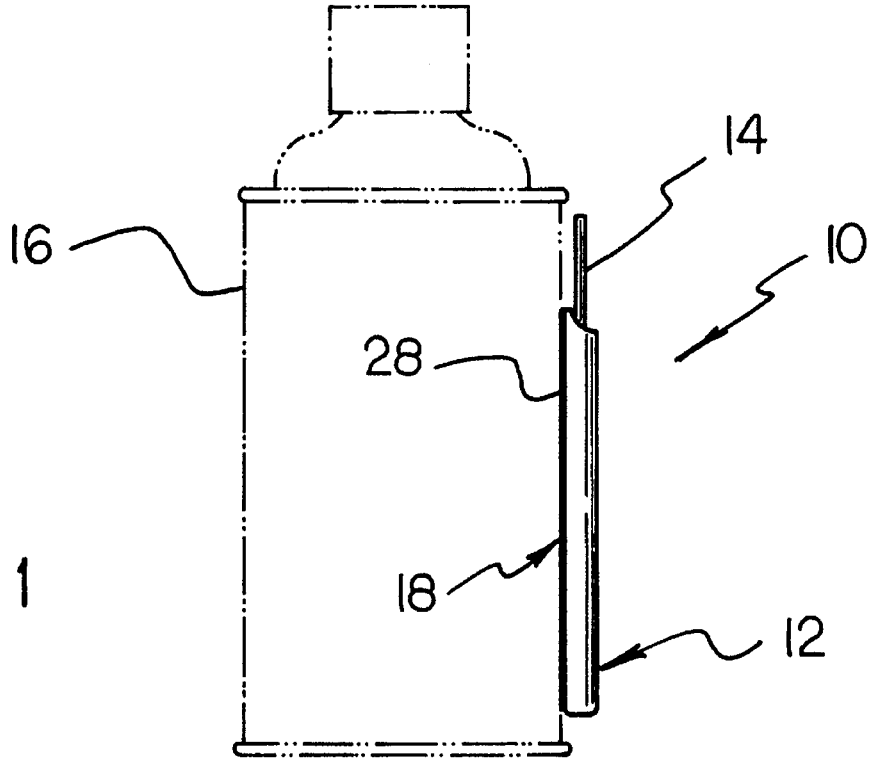
FIG. 1 is a front elevational view of an container attachable spray tube holder according to the present invention, in use.

With reference now to the drawings, and in particular to FIGS. 1–4 thereof, a new container attachable spray tube holder embodying the principles and concepts of the present invention and generally designated by the reference numeral 10 will be described.

More specifically, it will be noted that the container attachable spray tube holder 10 comprises a tube receiver means 12 for receiving a spray tube 14 which can be fluidly and mechanically associated with an aerosol spray valve of a conventionally known aerosol metallic container 16, as shown in FIG. 1 of the drawings. A mounting means 18 is secured to the tube receiver means 12 for magnetically coupling the tube receiver means to a side of the metallic container 16. By this structure, an individual can store the spray tube 14 relative to the container 16 to preclude a loss or separation of the spray tube relative to the container.

Figure 2:
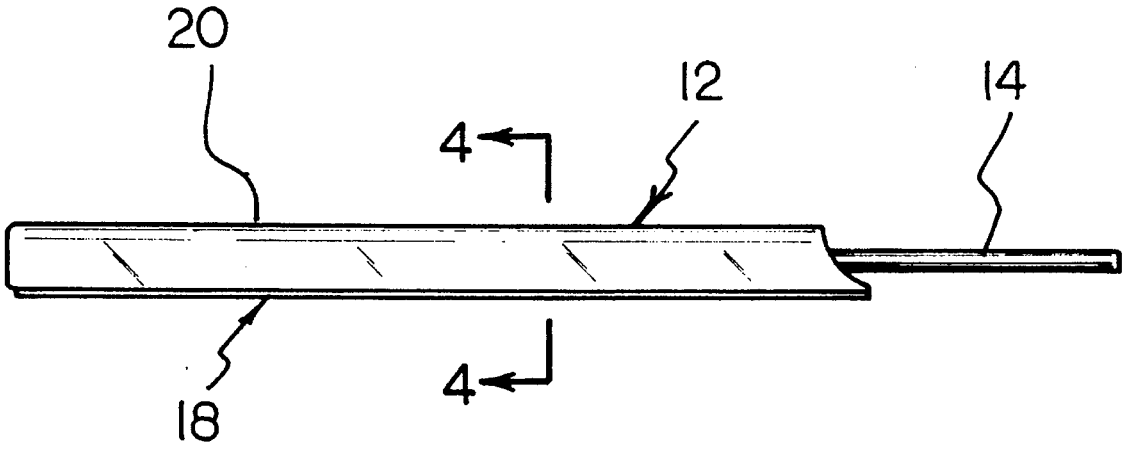
FIG. 2 is an elevational view of the container attachable spray tube holder, per se.
Figure 4:
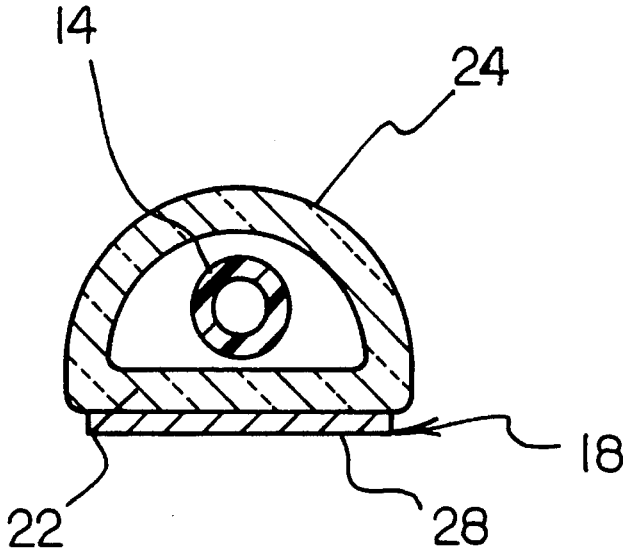
FIG. 4 is a cross sectional view taken along line 4—4 of FIG. 2.

As shown in FIG. 2, the receiver means 12 comprises an elongated container 20 dimensioned so as to receive only a portion of a longitudinal length of the spray tube 14 such that an upper portion of the spray tube projects beyond the elongated container to permit for ease of grasping of the tube prior to use thereof. As shown in FIG. 4, the elongated container 20 preferably includes a planar inner panel 22 to which the mounting means 18 is secured. The planar inner panel 22 includes substantially spaced and parallel longitudinal edges between which a semi-cylindrical outer panel 24 extends. The semi-cylindrical outer panel 24 thus includes a first longitudinal edge coupled to a first one of the longitudinal edges of the planar tuner panel 22, with a second longitudinal edge of the semi-cylindrical outer panel 24 being coupled to a second one of the longitudinal edges of the planar inner panel 22 to define a receiving space between the semi-cylindrical outer panel and the planar inner panel within which the spray tube 14 is received. An end panel 26 extends substantially orthogonally between the semi-cylindrical outer panel 24 and the planar inner panel 22 to limit a passage of the spray tube 14 through the tube receiver means 12. The semi-cylindrical outer panel 24 of the elongated container operates to deflect impacts against the tube receiver means 12 to discourage an unintentional impact-induced separation of the receiver means from the container 16. If desired, suitable structure mounted within the interior of the tube receiver means 12 can be provided to retain the spray tube 14 therewithin, even when the device 10 is inverted. Examples of such structure include a leaf spring extending from an interior surface of the receiver means 12, or a plurality of projections extending from the interior of the receiver means which frictionally engage the spray tube 14 as it is positioned therein. By this structure, the spray tube can be positioned with m the receiver means 12 for storage during periods of non-use thereof.

Figure 3:
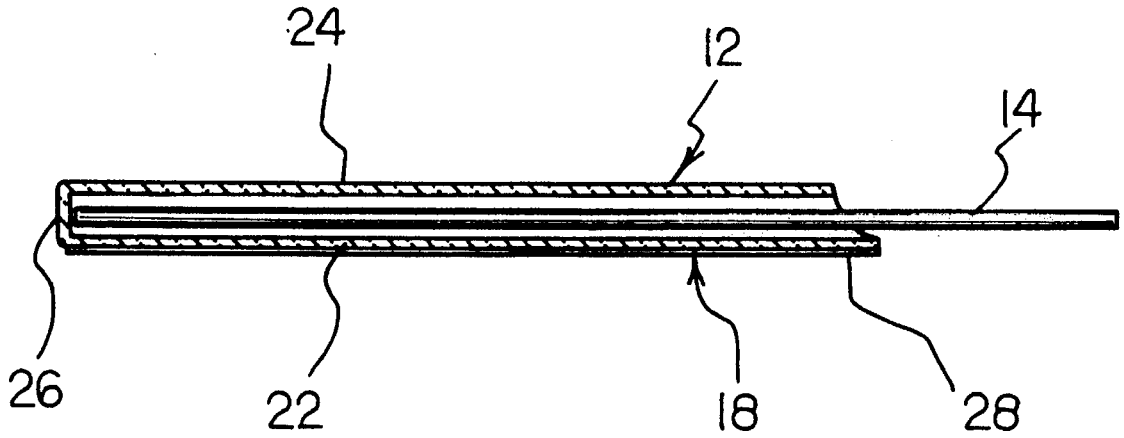
FIG. 3 is a cross sectional view of the invention.

As shown in FIGS. 1, 3, and 4, the mounting means 18 of the present invention 10 preferably comprises a magnetic strip 28 secured to the tube receiver means 12 for magnetically adhering the tube receiver means to the metallic container 16 in a longitudinally oriented configuration substantially as shown in FIG. 1 of the drawings. The magnetic strip is desirably coupled to and extends along substantially all of a longitudinal length of the planar inner panel 22 of the elongated container 20 of the tube receiver means 12.

In use, the container attachable spray tube holder 10 according to the present invention can be easily utilized to secure a spray tube 14 against loss wherein the spray tube 14 is stored adjacent to the container 16. The magnetic coupling of the mounting means 18 permits the device 10 to be magnetically adhered to surfaces of the container which are coated with oily fluids or like materials which preclude or reduce an effectiveness of an adhesive coupling therewith.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved container attachable spray tube holder for securing a spray tube relative to an aerosol container comprising in combination:

a metallic aerosol container having an aerosol dispensing valve;

a tube receiver means having an elongated container having a planar inner panel, a semi-cylindrical outer panel and an end panel extending substantially orthogonally between the semi-cylindrical outer panel and the planar inner panel, the planar inner panel having a substantially spaced and parallel longitudinal edges, the semi-cylindrical outer panel having a first longitudinal edge coupled to a first one of the longitudinal edges of the planar inner panel, with a second longitudinal edge of the semi-cylindrical outer panel being coupled to a second one of the longitudinal edges of the planar inner panel to define a receiving space between the semi-cylindrical outer panel and the planar inner panel;

a mounting means secured to the tube receiver means for magnetically coupling the elongated container of the tube receiver means to a side of the metallic container, the mounting means comprising a magnetic strip secured to the planner inner panel of the elongated container and magnetically adhering the elongated container to the metallic container in a longitudinally oriented configuration, the magnetic strip being extended along substantially all of the longitudinal length of the planar inner panel of the elongated container; and a spray tube having a longitudinal length, the longitudinal length of the spray tube being sized for allowing the spray tube to be positioned within the elongated container of the tube receiver means, secured to the metallic container by the mounting means, for storage prior to use, the spray tube having a portion of the length within the elongated container and an upper portion thereof projecting beyond the elongated container to permit ease of grasping of the tube for removal from within the elongated container for attaching to the dispensing valve of the metallic container.

* * * * *